US009860645B1

(12) United States Patent
Tsui

(10) Patent No.: US 9,860,645 B1
(45) Date of Patent: Jan. 2, 2018

(54) MULTI-DRIVER AIR-TUBE EARPHONE

(71) Applicant: Ryan C. Tsui, Yorba Linda, CA (US)

(72) Inventor: Ryan C. Tsui, Yorba Linda, CA (US)

( * ) Notice: Subject to any disclaimer, the term of this patent is extended or adjusted under 35 U.S.C. 154(b) by 0 days.

(21) Appl. No.: 15/399,370

(22) Filed: Jan. 5, 2017

(51) Int. Cl.
*H04R 5/02* (2006.01)
*H04R 5/033* (2006.01)
*H04R 1/10* (2006.01)

(52) U.S. Cl.
CPC ..... *H04R 5/033* (2013.01); *H04R 1/1008* (2013.01); *H04R 1/1016* (2013.01); *H04R 1/1041* (2013.01); *H04R 1/1075* (2013.01); *H04R 2420/07* (2013.01)

(58) Field of Classification Search
CPC .... H04R 5/033; H04R 1/1041; H04R 1/1016; H04R 2420/07; H04R 1/1008; H04R 1/1075
USPC ..... 381/309
See application file for complete search history.

(56) References Cited

U.S. PATENT DOCUMENTS

| | | | | |
|---|---|---|---|---|
| 299,300 | A | 5/1884 | Warth | |
| 1,321,265 | A | 11/1919 | Wagner | |
| 2,586,644 | A | 2/1952 | Gilbert | |
| 3,667,569 | A | 6/1972 | Mackey et al. | |
| 4,090,042 | A | 5/1978 | Larkin | |
| 4,261,432 | A | 4/1981 | Gunterman | |
| 4,325,453 | A | 4/1982 | Moussette | |
| 4,347,911 | A | 9/1982 | Bertagna et al. | |
| 4,588,868 | A | 5/1986 | Bertagna et al. | |
| 5,528,689 | A | 6/1996 | Chan | |
| 6,377,824 | B1 | 4/2002 | Ingbir et al. | |
| 6,453,044 | B1 | 9/2002 | Klitzner et al. | |
| 6,631,279 | B2 | 10/2003 | Rivera | |
| 6,920,228 | B2 | 7/2005 | Redmer et al. | |
| 6,961,440 | B1 | 11/2005 | Schlaegel | |
| 7,317,806 | B2 * | 1/2008 | Harvey | H04R 1/1016 381/322 |
| 8,090,134 | B2 | 1/2012 | Takigawa et al. | |
| 8,170,262 | B1 | 5/2012 | Liu | |
| 8,548,186 | B2 | 10/2013 | Alwicker et al. | |
| 8,761,424 | B2 | 6/2014 | Wubker et al. | |
| 8,983,101 | B2 | 3/2015 | Grinker et al. | |
| 9,100,761 | B2 | 4/2015 | Grinker et al. | |
| 2002/0096391 | A1 | 7/2002 | Smith et al. | |
| 2003/0133585 | A1 | 7/2003 | Cheung | |
| 2004/0125979 | A1 | 7/2004 | Elidan et al. | |
| 2010/0061582 | A1 | 3/2010 | Takigawa et al. | |

* cited by examiner

*Primary Examiner* — Paul S Kim
(74) *Attorney, Agent, or Firm* — Dan Brown Law Office; Daniel R. Brown

(57) ABSTRACT

An earphone assembly with a manifold at the earpiece having a first driver directly coupled and second driver coupled through a tube, both driven by a common signal source such, which results in a propagation time differential in the arrival of first emitted signals and second emitted signals from the drivers, respectively, at the earpiece.

17 Claims, 4 Drawing Sheets

MULTI-DRIVER AIR-TUBE EARPHONE

REFERENCE TO RELATED APPLICATIONS

None.

BACKGROUND OF THE INVENTION

Field of the Invention

The present invention relates to earphones. More particularly, the present invention relates to multi-driver earphones that employ a driver directly coupled to an earpiece and tube-coupled driver, which results in a propagation time differential to enhance spatial characteristics of the audio experience.

Description of the Related Art

Earphones have become the dominant user audio interface devices for end users of audio, video, gaming, and other communications equipment. Earphones are offered in a range of configurations with earpieces to engage the human ear, including ear-fitting earpieces, in-ear-canal earpieces, circumaural earpieces, and supra-aural earpieces. These are offered in a range of quality and performance characteristics from low cost value leaders to high cost audiophile grade devices. The industrial design is also offered in a range of configurations that vary in size, weight, appearance, comfort, and style.

Earphone producers compete in a large marketplace and strive to offer performance and features that end users desire, always looking for ways to distinguish their products over the wide range of options that are available. Varied industrial designs can be appealing, as a matter of style, to end users. However, audio sound characteristic ultimately determine the acceptance of earphone products to end users. As is the case with many audio and acoustic products, there is a balance between ultimate accuracy and pleasing coloration of sound. For example, consider the trade-off between solid-state amplifiers that offer amazingly low levels a distortion and the warm audio quality found in vacuum tube amplifiers. Many users prefer the warmth of the tube amplifiers. Similarly, consider the characteristic differences between digitally recorded music and analog recorded music distributed on vinyl records, where many users prefer the complete analog signal path that records employ. It's clear that the communications equipment and medium of distribution represent opportunities to enhance the listening experience of end users as well as the desirability of the products being offered. Thus, it can be appreciated that there is a need in the art for earphone technology and designs that enhance the listening experience of end user.

SUMMARY OF THE INVENTION

The need in the art is addressed by apparatus of the present invention. The present disclosure teaches an earphone assembly that includes a manifold and a first driver, which emits first acoustic signals, directly coupled to a first port of the manifold, and a second driver, which emits second acoustic signals, coupled to a second port of the manifold through a tube having a length greater than 50 millimeters, and an earpiece coupled to an ear port of the manifold. The first driver and the second driver are driven from a common signal source, which results in a propagation time differential in the arrival of the first emitted signals and the second emitted signals at the third port.

In a specific embodiment of the foregoing earphone assembly, the tube has a length in the range between 50 millimeters and 250 millimeters. In another specific embodiment, the first port and the second port of the manifold are arranged orthogonal to one another.

In a specific embodiment, the foregoing earphone assembly further includes a conduit coupled to the first port that extends into the manifold past the second port with an opening oriented in the direction of the ear port. In another specific embodiment, the earphone assembly further includes a conduit coupled to the second port that extends into the manifold with an opening oriented in the direction of the ear port. In a refinement to this embodiment, the first port and the second port are arranged to emit the first signals and the second signals into the manifold in directions parallel to one another.

In a specific embodiment, the foregoing earphone assembly further includes a first conduit coupled to the first port that extends into the manifold with a first outlet oriented in the direction of the ear port, and a second conduit coupled to the second port that extends into the manifold with a second outlet oriented in the direction of the ear port.

In a specific embodiment of the foregoing earphone assembly wherein the common signal source is a first channel of a stereo signal source, which further provides a second channel, and wherein the manifold, first driver, tube, second driver, and earpiece constitute a first earphone, the earphone assembly further includes a second earphone comprised of substantially identical elements as the first earphone, which is driven by the second channel to thereby implement a stereo earphone assembly.

In a specific embodiment, the foregoing earphone assembly further includes a filter circuit coupled to receive the common signal source, which selectively couples a first range of signal frequencies to the first driver and a second range of signal frequencies to the second driver. In a refinement to this embodiment, the first range of signal frequencies and the second range of signal frequencies each comprise an overlap portion of signal frequencies such that both of the first driver and the second driver receive the overlap portion of signal frequencies.

In a specific embodiment of the foregoing earphone assembly, the first driver and the second driver are selected from a dynamic driver, a balanced armature driver, and an electrostatic driver. In another specific embodiment, the earpiece is selected from an ear-fitting earpiece, in-ear-canal earpiece, a circumaural earpiece, and a supra-aural earpiece. In a refinement to this embodiment, the earpiece is removably connected to the ear port of the manifold.

In a specific embodiment of the foregoing earphone assembly, the second driver further comprises a housing having plural sub-drivers disposed therein to couple plural corresponding audio frequency bands of the second acoustic signals to the tube.

The present disclosure also teaches a stereo earphone assembly, that is driven by a left signal and a right signal, and which includes a left manifold with a left earpiece acoustically coupled thereto, and a first left driver driven by the left signal, which directly emits first left acoustic signals thereinto. And, a second left driver driven by the left signal, which emits second left acoustic signals, coupled to the left manifold through a left tube having a length greater than 50 millimeters, which results in a propagation time differential in the arrival of the first left and second left emitted acoustic signals at the left manifold. The stereo earphone also includes a right manifold with a right earpiece acoustically coupled thereto, and a first right driver driven by the right signal, which directly emits first right acoustic signals thereinto, and a second right driver driven by the right signal, which emits second right acoustic signals, coupled to the right manifold through a right tube having a length greater than 50 millimeters, which results in a propagation time differential in the arrival of the first right and second right emitted signals at the right manifold.

In a specific embodiment, the foregoing stereo earphone assembly further includes a driver housing disposed between the distal ends of the left tube and the right tube, which houses both of the second left driver and the second right driver, and thereby forms a loop of the left tube and right tube between the right manifold and the left manifold.

The present disclosure also teaches a stereo earphone assembly that can be driven by a left signal and a right signal. The assembly includes a left manifold with a left earpiece acoustically coupled thereto, and a first left driver driven by the left signal, which directly emits first left acoustic signals thereinto. The assembly also includes a right manifold with a right earpiece acoustically coupled thereto, and a first right driver driven by the right signal, which directly emits first right acoustic signals thereinto. A tube, having a length of at least 100 millimeters, is acoustically coupled to both of the left manifold and the right manifold, and has a driver port located along its length. A common driver, driven by both of the right signal and the left signal, emits both of second right acoustic signals and second left acoustic signals, and is coupled to the driver port to thereby couple both of the second right acoustic signals and second left acoustic signals to both of the left manifold and the right manifold. The tubing length results in a propagation time differential according to the length of the tube from the driver port to the left manifold and the right manifold, respectively.

BRIEF DESCRIPTION OF THE DRAWINGS

FIG. 15B is a section view drawing of an earphone air-tube according to an illustrative embodiment of the present invention.

FIG. 16B is a section view drawing of an earphone air-tube according to an illustrative embodiment of the present invention.

DESCRIPTION OF THE INVENTION

Figure 1A:
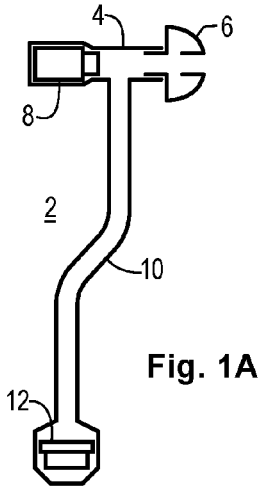
FIG. 1A is a section view drawing of an earphone according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus. Accordingly, the apparatus components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The earphone designs of the present disclosure employ an acoustic manifold with an ear port. The ear port is coupled to an earpiece for engaging a user's ear, which can take on a variety of configurations as desired for various embodiments. A first driver is directly coupled to the manifold. The first driver is driven with an electric signal comprising audio frequency signals, such as voice and music. The first driver may be a dynamic transducer, a balanced armature transducer, an electrostatic transducer, or a piezoelectric transducer. Thus, the first driver provides a directly coupled acoustic signal, through the manifold and to the user's ear. A second driver is coupled to the manifold through a tube having a suitable length. Like the first driver, the second driver is driven by an electrical signal and outputs an acoustic signal, and may be selected from the same list of transducer types. In an illustrative embodiment, both drivers are driven by a common signal, such as an audio channel of a monaural, stereo or multi-channel source. Electric filters may be used to limit the range of frequencies from the signal source that ultimately reach each of the two drivers. Note the plural drivers may be coupled to each of the direct coupled port and tube coupled port on the manifold. Thus, the number of drivers can range from two to many. For example, one driver could be direct coupled, and two discrete drivers could be coupled through the tube, yielding a three-driver configuration. Three-band filtering could be employed to drive the three drivers in this embodiment, for example.

In operation, the user hears acoustic signals from both the direct-coupled driver and tube-coupled driver. The tube utilized in coupling the second driver is selected to enhance the sound quality heard by the user. Particularly, when the user experiences sounds reproduced by both drivers simultaneously. The experience has a spatial characteristic that adds a pleasing complexity to the sound. This can be likened to the enhanced experience that a well-designed concert hall adds to an orchestral performance versus a performance in a lesser facility. The enhanced acoustic characteristics are controlled by the tube configuration, including its length, cross-sectional area and volume, as well as the tubing material, tubing path, and the tube interface to the manifold. Empirical testing has determined that a minimum length of fifty millimeters is needed to result in enhanced audio quality, and that length greater than two hundred fifty millimeters introduces too much propagation delay, frequency dependent attenuation, and a somewhat muddled sound quality. In illustrative embodiments, lengths in the range of one hundred to one hundred fifty millimeters, and an interior diameter of about 2.5 millimeters provided a pleasing spatial quality. Vinyl and PVC tubing performed well, however other tubing material can be employed. Since the tubing connected driver hangs from the ear manifold, use of flexible tubing is beneficial, although not a requirement. It should be noted that relative straight tubing runs and gradual turns are preferred over tight bends and circuitous tubing paths, as these tend to attenuate the audio signals.

The effects that the tubing extension introduces a propagation delay of the acoustic signal as compared to the direct coupled driver, and echo and reverberation of the acoustic signals, as well as a frequency dependent attenuation. Generally speaking, higher frequencies experience greater attenuation, although this can be mitigated by increasing the tubing diameter, shortening its length, and increasing the driving signal magnitude. The enhanced sound quality is largely dependent on the acoustic differential between the direct-coupled driver and the tube-coupled driver. This differential results in the aforementioned spatial effect.

Reference is directed to FIG. 1A, which is a section view drawing of an earphone assembly 2 according to an illustrative embodiment of the present invention. A manifold 4 is coupled to an earpiece 6, which is schematically presented as an in-ear-canal earpiece. A first driver 8, schematically presented as a balanced armature driver, is directly coupled to the manifold 4. Thusly, the acoustic signal output from the first driver 8 passes through the manifold and out the earpiece 6. A second driver 12, which is schematically presented as a dynamic driver, is coupled through a tube 10 and into the manifold 4, and is thereby coupled to the earpiece 6. In the illustrative embodiment, the manifold 4 and driver 8, 12 housings are fabricated from rigid plastic while the tube 10 is a vinyl tube having a length of 100 millimeters to 150 millimeters, with an interior diameter of 2.5 millimeters. This arrangement yields a pleasing spatial quality to the user. Variations of the length from 50 millimeters to 250 millimeters have shown to also provide a pleasing spatial effect.

Figure 1B:
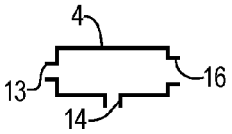
FIG. 1B is a section view drawing of an earphone manifold according to an illustrative embodiment of the present invention.

Reference is directed to FIG. 1B, which is a section view drawing of an earphone manifold 4 according to an illustrative embodiment of the present invention, which corresponds to the embodiment presented in FIG. 1A. FIG. 1B presents a more detailed view of the manifold. The various connection ports are individually identified, which will be useful in later descriptions and analysis of the illustrative designs. The earpiece (item 6 in FIG. 1A) connects to ear port 16. The first driver (item 8 in FIG. 1A) connects to first port 13, and the tube (item 10 in FIG. 1A) connects to a second port 14. Note that in this embodiment, the manifold 4 is an open chamber where the first port 13 and second port 14 are oriented orthogonal to one another. This configuration mixes the acoustic signals in an un-oriented manner. It will be appreciated that acoustic signals not only propagate toward the ear port 16, but also toward the two drivers (not shown) through the ports 13, 14. This arrangement increases the mixing and reverberation within the earphone assembly, which has an effect on the spatial quality of the user perceived sound.

Figure 2A:
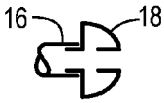
FIGS. 2A, 2B, 2C, and 2D are section view drawings of in-ear-canal, ear-fitting, supra-aural, and circumaural, respectively, earphone interfaces according to an illustrative embodiment of the present invention.
Figure 2B:
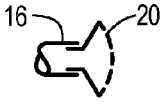
Figure 2C:
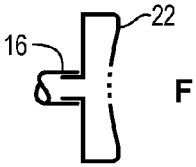
Figure 2D:
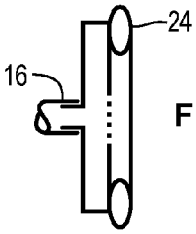

Reference is directed to FIGS. 2A, 2B, 2C, and 2D, which are section view drawings of in-ear-canal, ear-fitting, supra-aural, and circumaural earpieces, respectively, according to illustrative embodiments of the present invention. These figures correspond to FIG. 1B in that FIGS. 2A through 2D present various earpiece designs that are interchangeably connected to the ear port 16 of the manifold 4. FIG. 2A depicts a conventional in-ear-canal earpiece where an ear insert 18, fabricated from a highly pliable material, is pushed into the user's ear canal. FIG. 2B depicts a conventional ear-fitting earpiece where an ear insert 20 is configured to be pressed into the concha to engage and rest upon the targus and anti-targus of the user's ear. FIG. 2C depicts a conventional supra-aural earpiece 22, which is configured to be urged against the outer surface of the user's ear with a head band (not shown) or similar structure. FIG. 2D depicts a conventional circumaural earpiece 24, which is configured to cover the user's ear and be urged against the side of the user's head with a head band (not shown) or similar structure.

Figure 3:
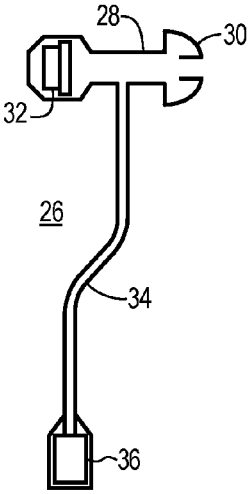
FIG. 3 is a section view drawing of an earphone according to an illustrative embodiment of the present invention.

Reference is directed to FIG. 3, which is a section view drawing of an earphone assembly 26 according to an illustrative embodiment of the present invention. A manifold 28 is coupled to an earpiece 30, which is schematically presented as an in-ear-canal earpiece. A first driver 32, schematically presented as a dynamic driver, is directly coupled to the manifold 28 along an axis generally in-line with the earpiece 30 and the user's ear canal (not shown). Thusly, the acoustic signals output from the first driver 32 pass straight through the manifold 28 and out of the earpiece 30. A second driver 36, which is schematically presented as a balanced armature driver, is coupled through a narrow tube 34 and into the manifold 28, and is thereby acoustically coupled to the earpiece 30. In this illustrative embodiment, the tube 10 is a small diameter vinyl tube having a length of 100 millimeters to 150 millimeters, with an interior diameter of approximately one millimeters. The smaller diameter tube 34 is suited to low frequency components of the audio signals being reproduced. The smaller diameter tubing is also preferable where greater tube flexibility is desired. This arrangement yields a pleasing spatial quality to the user. Variations of the tune 34 length from 50 millimeters to 250 millimeters have shown to also provide a pleasing spatial effect.

Figure 4A:
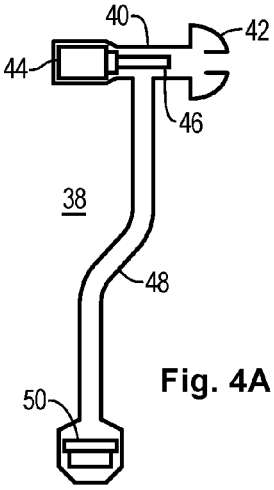
FIG. 4A is a section view drawing of an earphone according to an illustrative embodiment of the present invention.

Reference is directed to FIG. 4A, which is a section view drawing of an earphone assembly 38 according to an illustrative embodiment of the present invention. A manifold 40 is coupled to an earpiece 42. A first driver 44 is directly coupled to the manifold 40 along an axis generally in-line with the earpiece 42 and the user's ear canal (not shown). A second driver 50 is coupled through a tube 48 and into the manifold 40, and is thereby acoustically coupled to the earpiece 42. Note that the acoustic signals from the two drivers 44, 50 enter the manifold in an orthogonal relationship. In this illustrative embodiment, an internal conduit 46 is provided to direct the acoustic signals from the first driver 44 past the location in the manifold 40 where the acoustic signals from the tube 48 enter the manifold 40. This arrangement directs the pressure wave fronts of the first driver 44 directly toward the earpiece 42, so as to provide a degree of isolation that reduces the amount of sound pressure from the tube 48 from travelling back toward the first driver 44. This changes the spatial effect and increases the efficiency of sound transfer to the earpiece 42, and subjectively results in a cleaner sound from the earphone assembly 38.

Figure 4B:
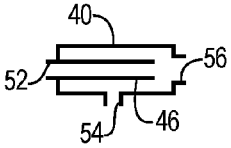
FIG. 4B is a section view drawing of an earphone manifold according to an illustrative embodiment of the present invention.

Reference is directed to FIG. 4B, which is a section view drawing of an earphone manifold 40 according to an illustrative embodiment of the present invention, which corresponds to the embodiment presented in FIG. 4A. FIG. 4B presents a more detailed view of the manifold 40. The various connection ports are individually identified. The earpiece (item 42 in FIG. 4A) connects to ear port 56. The first driver (item 44 in FIG. 4A) connects to first port 52, and the tube (item 48 in FIG. 4A) connects to a second port 54. An internal conduit 46 is coupled to first port 52 and is provided to direct the acoustic signals past the location of the second port 54 in the manifold 44, which is where the acoustic signals from the tube 48 (not shown) enter the manifold 44. As noted above, the purpose of the conduit is to direct the wave fronts of the acoustic signals emanating from the conduit 46 directly toward the ear port 56, so as to provide a degree of isolation between the ports 52, 54, and reduce the magnitude of the acoustic signals that feed back from each driver to the other driver.

Figure 5A:
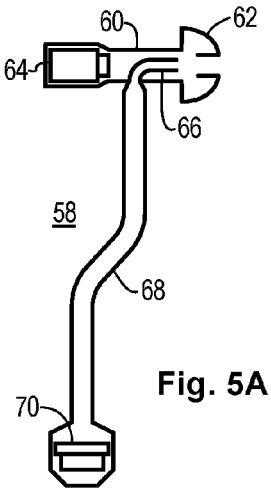
FIG. 5A is a section view drawing of an earphone according to an illustrative embodiment of the present invention.

Reference is directed to FIG. 5A, which is a section view drawing of an earphone assembly 58 according to an illustrative embodiment of the present invention. A manifold 60 is coupled to an earpiece 62. A first driver 64 is directly coupled to the manifold 60 along an axis generally in-line with the earpiece 62 and the user's ear canal (not shown). A second driver 70 is coupled through a tube 68 and into the manifold 60, and is thereby acoustically coupled to the earpiece 62. In this illustrative embodiment, an internal conduit 66 is provided to turn the acoustic signal received through the tube 68 and direct those acoustic signals directly toward the earpiece 62. This arrangement directs the pressure wave fronts of the second driver 70 directly toward the earpiece 62, so as to provide a degree of isolation that reduces the amount of sound pressure from the tube 68 and conduit 66 from travelling back toward the first driver 64. This changes the spatial effect and increases the efficiency of sound transfer to the earpiece 62, and subjectively results in a cleaner sound from the earphone assembly 58.

Figure 5B:
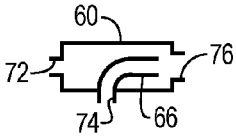
FIG. 5B is a section view drawing of an earphone manifold according to an illustrative embodiment of the present invention.

Reference is directed to FIG. 5B, which is a section view drawing of an earphone manifold 60 according to an illustrative embodiment of the present invention, which corresponds to the embodiment presented in FIG. 5A. FIG. 5B presents a more detailed view of the manifold 60. The various connection ports are individually identified. The earpiece (item 62 in FIG. 5A) connects to ear port 76. The first driver (item 64 in FIG. 5A) connects to first port 72, and the tube (item 68 in FIG. 5A) connects to a second port 74. An internal conduit 66 is coupled to second port 74 and is curved to redirect the acoustic signal wave fronts directly toward the ear port 76, as illustrated. As noted above, the purpose of the conduit is to direct the wave fronts of the acoustic signals emanating from the conduit 66 directly toward the ear port 76, so as to provide a degree of isolation between the ports 72, 74, and reduce the magnitude of the acoustic signals that feed back from each driver to the other driver.

Figure 6A:
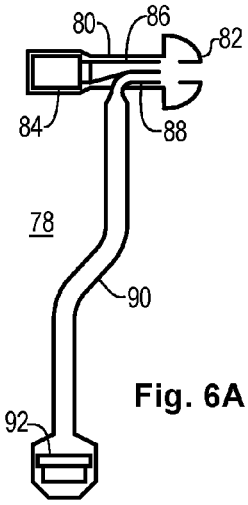
FIG. 6A is a section view drawing of an earphone according to an illustrative embodiment of the present invention.

Reference is directed to FIG. 6A, which is a section view drawing of an earphone assembly 78 according to an illustrative embodiment of the present invention. A manifold 80 is coupled to an earpiece 82. A first driver 84 is directly coupled to the manifold 80. A second driver 92 is coupled through a tube 90 and into the manifold 80, and is thereby acoustically coupled to the earpiece 82. In this illustrative embodiment, there is a pair of internal conduits 86, 88, which couple the acoustic signals from the two drivers and directs them towards the earpiece 82, as will be more fully discussed below.

Figure 6B:
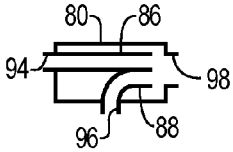
FIG. 6B is a section view drawing of an earphone manifold according to an illustrative embodiment of the present invention.

Reference is directed to FIG. 6B, which is a section view drawing of an earphone manifold 80 according to an illustrative embodiment of the present invention, which corresponds to the embodiment presented in FIG. 6A. FIG. 6B presents a more detailed view of the manifold 80. The various connection ports are individually identified. The earpiece (item 82 in FIG. 6A) connects to ear port 98. The first driver (item 84 in FIG. 6A) connects to first port 94, and the tube (item 90 in FIG. 6A) connects to a second port 96. Each port 94, 96 is coupled to a respective internal conduit 86, 88. The internal conduits 86, 88 are routed within the manifold 80 redirect the acoustic signal wave fronts directly toward the ear port 98, as illustrated. As noted above, the purpose of the conduit is to direct the wave fronts of the acoustic signals so as to provide a degree of isolation between the ports 94, 96, and reduce the magnitude of the acoustic signals that feed back from each driver to the other driver.

Figure 7:
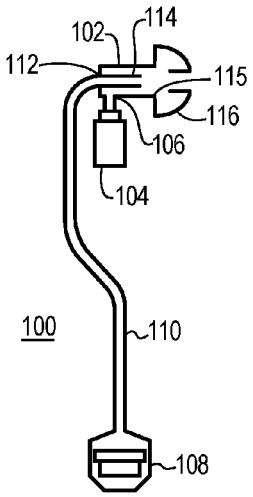
FIG. 7 is a section view drawing of an earphone according to an illustrative embodiment of the present invention.

Reference is directed to FIG. 7, which is a section view drawing of an earphone assembly 100 according to an illustrative embodiment of the present invention. A manifold 102 is coupled to an earpiece 116 through an ear port 115. A first driver 104 is directly coupled to the manifold 102 through a first port 106 that is aligned orthogonal to the ear port 115. A second driver 108 is coupled through a tube 110 and into the manifold 102 through a second port 112, which is aligned orthogonal to the first port 106. In this illustrative embodiment, an internal conduit 114 is provided to direct the acoustic signals from the second port 112 into the manifold 102 past the location where the acoustic signals from the first port 106 enter the manifold 102. This arrangement result in a coaxial feed of the acoustic waves entering through the two ports 106, 112 and out the ear port 115 so as to cleanly blend the signals, increase acoustic efficiency, and reduce the magnitude of the acoustic signals that feed back from each driver to the other driver.

Figure 8:
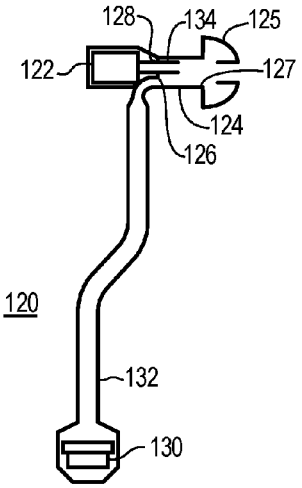
FIG. 8 is a section view drawing of an earphone according to an illustrative embodiment of the present invention.

Reference is directed to FIG. 8, which is a section view drawing of an earphone assembly 120 according to an illustrative embodiment of the present invention. A manifold 124 is coupled to an earpiece 125 through an ear port 127. A first driver 122 is directly coupled to the manifold 124 through a first port 128 that is aligned in parallel with the ear port 115. A second driver 130 is coupled through a tube 132 and into the manifold 124 through a second port 126, which is also aligned in parallel with the ear port 127. Note that the reference to parallel is based on the central axes of the acoustic waves emanating from the respective ports, i.e. the direction the sound pressure waves travel. In this illustrative embodiment, an internal conduit 134 is provided to direct the acoustic signals from the first port 128 into the manifold 134. This arrangement result in a parallel feed of the acoustic waves entering through the two ports 128, 126 and out the ear port 127 so as to cleanly blend the signals, increase acoustic efficiency, and reduce the magnitude of the acoustic signals that feed back from each driver to the other driver.

Figure 9:
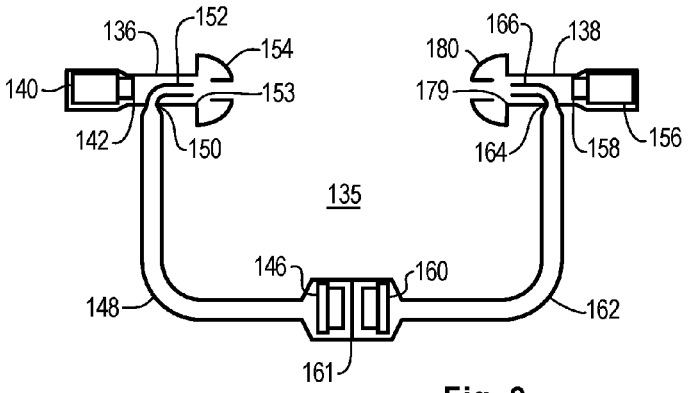
FIG. 9 is a section view drawing of a stereo earphone according to an illustrative embodiment of the present invention.

Reference is directed to FIG. 9, which is a section view drawing of a stereo earphone assembly 135 according to an illustrative embodiment of the present invention. A pair of manifolds 136, 138 each comprises a first driver 140, 156 coupled through respective first ports 142, 158. Each manifold 136, 138 further includes respective ear ports 153, 179 coupled to respective earpieces 154, 180. Each manifold 136, 138 further includes respective second ports 150, 164 coupled to respective tubes 148, 162. The tubes 148, 162 connect to a pair of respective second drivers 146, 160 located in a common housing 161. The pair of second drivers 146, 160 are acoustically isolated from one another by the housing 161. The use of a common housing 161 completes a mechanical connection of the first tube 148 and the second tube 162 so as to form a loop between the two manifold 136, 138. This arrangement forms a unified assembly that comfortably hangs on the users ears (not shown).

Figure 10:
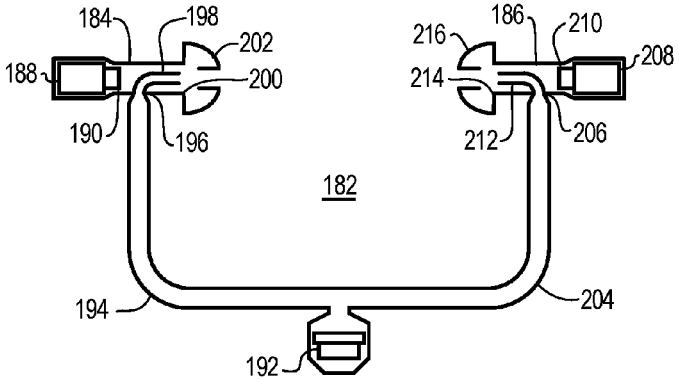
FIG. 10 is a section view drawing of a stereo earphone according to an illustrative embodiment of the present invention.

Reference is directed to FIG. 10, which is a section view drawing of a stereo earphone assembly 182 according to an illustrative embodiment of the present invention. A pair of manifolds 184, 186 each comprises a first driver 188, 208 coupled through respective first ports 190, 210. Each manifold 184, 186 further includes respective ear ports 200, 214 coupled to respective earpieces 202, 216. Each manifold 184, 186 further includes respective second ports 196, 206 coupled to respective tubes 194, 204. The tubes 194, 204 connect to a common second driver 192. The use of a common driver 192 completes a mechanical connection of the first tube 194 and the second tube 204 so as to form a loop between the two manifold 184, 186. This arrangement forms a unified assembly that comfortably hangs on the users ears (not shown). The common driver 192 may be driven by both of the left and right audio signals, which does remove the stereo isolation between the channels. However, it is know that in the case of the lower frequency ranges, stereo isolation is not necessary, such as is the case with sub-woofer frequencies. This arrangement reduces the size, weight, and cost of the earphone assembly 182.

Figure 11:
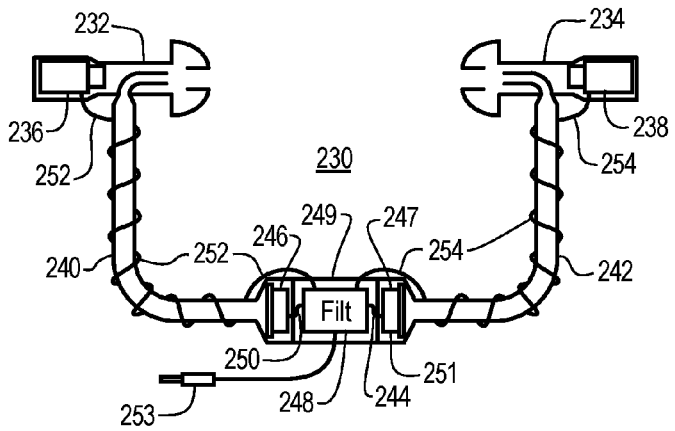
FIG. 11 is a section view drawing of a stereo earphone according to an illustrative embodiment of the present invention.

Reference is directed to FIG. 11, which is a section view drawing of a stereo earphone assembly 230 according to an illustrative embodiment of the present invention. A pair of manifolds 232, 234 each comprises direct-coupled first drivers 236, 238, and respective tubes 240, 242 coupled to respective second drivers 246, 247 located in a common housing 249. This drawing FIG. 11 particularly illustrates one exemplar circuit schematic and wiring diagram. In this embodiment, the signal source is received through a suitable jack 253 that is coupled to a filter circuit 248 located in the housing 249. For example, the filter may comprise a stereo low pass filter to segregate lower frequencies and a stereo high-pass filter to segregate higher frequencies. These filters will comprise an overlap range of frequencies that are supplied to both the low frequencies range and the high frequencies range. This overlap enhances the spatial quality of the reproduced sound, as was discussed hereinbefore. The filter 248 outputs signals to drive the several drivers.

The filter 248 in FIG. 11 couples stereo low frequency range signals to the pair of second drivers 246, 247 though internal wires 250, 244, respectively. The wiring 250, 244 is disposed entirely within the housing 249. Thus, these drivers 246, 247 constitute the left and right woofers, using the conventional stereo loudspeaker terminology. The filter 248 also outputs stereo high frequency range signals to the pair of first drivers 236, 238 through external wires 252, 254, respectively. Thus, these drivers 236, 238 constitute the left and right stereo tweeters, using the conventional stereo loudspeaker terminology. Of course, it is necessary to run the wires 252, 254 from the filter 248 to the pair of first drivers 236, 238. In this embodiment, these wires 252, 254 are wrapped about the exterior of the tubes 240, 242, respectively.

Figure 12:
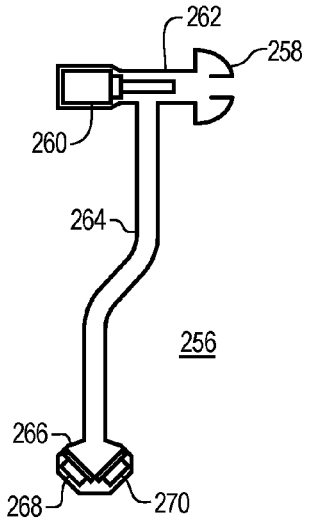
FIG. 12 is a section view drawing of an earphone according to an illustrative embodiment of the present invention.

Reference is directed to FIG. 12, which is a section view drawing of an earphone assembly 256 according to an illustrative embodiment of the present invention. A manifold 262 is coupled to an earpiece 258. A first driver 260 is directly coupled to the manifold 262 along an axis generally in-line with the earpiece 258. A tube 264 is also coupled to the manifold 262. At the distal end of the tube 264, a housing 266 house a second driver 268 and a third driver 270. Thus, this embodiment illustrates a triple driver implementation, and affords the designer the ability to segregate the audio frequency ranges into three ranges. For example, the first driver 260 might be the tweeter, the second driver 268 would be the mid-range, and the third driver 270 would be the woofer. Of course, the manifold might have a pair of drivers directly coupled as well. In this manner, the designer is enabled to use a range of discreet drivers from two to many under the teachings of the present invention.

Figure 13A:
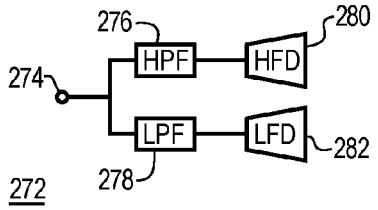
FIG. 13A is a functional block electrical diagram of an earphone according to an illustrative embodiment of the present invention.

Reference is directed to FIG. 13A, which is a functional block electrical diagram 272 of an earphone according to an illustrative embodiment of the present invention. This figure illustrates the basic signal processing of this embodiment. An audio signal source inputs an audio signal to an input connector 274. The audio signal is coupled to both a high pass filter ('HPF') 276 and a low pass filter ("LPF") 278. The HPF 276 passes higher frequency portions, for example signals greater than 200 Hz, to a high frequency driver ("HFD") 280. The LPF 278 passes lower frequency portions, for example signals lower than 1,000 Hz, to a low frequency driver ("LFD") 282. This basic circuit is repeated for the second channel in a stereo implementation.

Figure 13B:
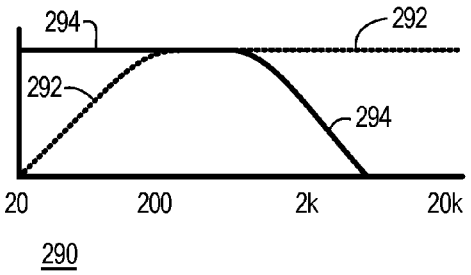
FIG. 13B is a frequency response diagram of an earphone according to an illustrative embodiment of the present invention.

Reference is directed to FIG. 13B, which is a frequency response plot 290 of an earphone according to an illustrative embodiment of the present invention. FIG. 13B is a suitable response curve for the circuit discussed with respect to FIG. 13A. In FIG. 13B, frequency is plotted along the ordinate axis of the plot 290 and amplitude is plotted along the abscissa axis of the plot 290. The HPF plot 292 is shown in broken line and illustrated a response corner at about 200 Hz. The LPF plot 294 is shown in solid line and illustrates a response corner at about 1,000 Hz. Note that there is an overlap in the range of pass-band frequencies, between about 200 Hz and 1,000 Hz. This overlap range is reproduced by both the LFD and HFD (see FIG. 13A), and is a range in which the propagation time difference produced by the tube offers enhanced spatial characteristics.

Figure 14A:
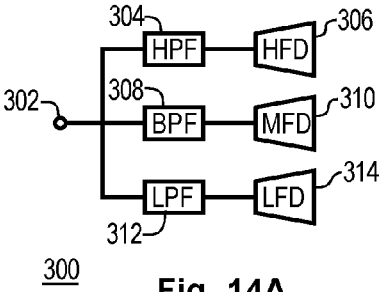
FIG. 14A is a functional block electrical diagram of an earphone according to an illustrative embodiment of the present invention.

Reference is directed to FIG. 14A, which is a functional block electrical diagram 316 of an earphone assembly according to an illustrative embodiment of the present invention. This figure illustrates the basic signal processing for a three-band implementation of the present disclosure. An audio signal source inputs an audio signal to an input connector 302. The audio signal is coupled to all of a high pass filter ('HPF') 304, a band-pass filter ("BPF") 308, and a low pass filter ("LPF") 312. The HPF 304 passes higher frequency portions, for example signals greater than 4,000 Hz, to a high frequency driver ("HFD") 306. The BPF 308 passes mid-range frequency portions, for example signals between 200 Hz and 2,000 Hz, to a mid frequency driver ("MFD") 310. The LPF 312 passes lower frequency portions, for example signals lower than 100 Hz, to a low frequency driver ("LFD") 314. This basic circuit is repeated for the second channel in a stereo implementation.

Figure 14B:
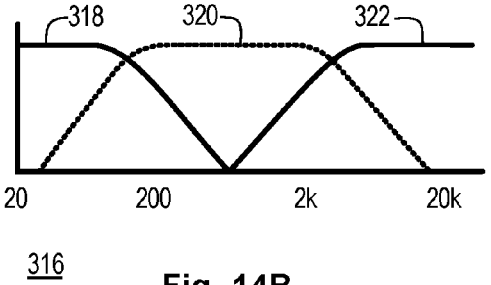
FIG. 14B is a frequency response diagram of an earphone according to an illustrative embodiment of the present invention.

Reference is directed to FIG. 14B, which is a frequency response diagram 316 of an earphone according to an illustrative embodiment of the present invention. FIG. 14B is a suitable response curve for the circuit discussed with respect to FIG. 14A. In FIG. 43B, frequency is plotted along the ordinate axis of the plot 316 and amplitude is plotted along the abscissa axis of the plot 316. The HPF plot 322 is shown in solid line and illustrated a response corner at about 4,000 Hz. The mid frequency plot 320 is shown in broken line and illustrates a response with corners at about 200 Hz and 1,000 Hz. The LPF plot 318 is also shown in solid line and illustrated a response corner at about 100 Hz. Note that there is an overlap in the range of pass-band frequencies. These overlaps are the ranges in which the propagation time difference produced by the tube offers enhanced spatial characteristics.

Figure 15A:
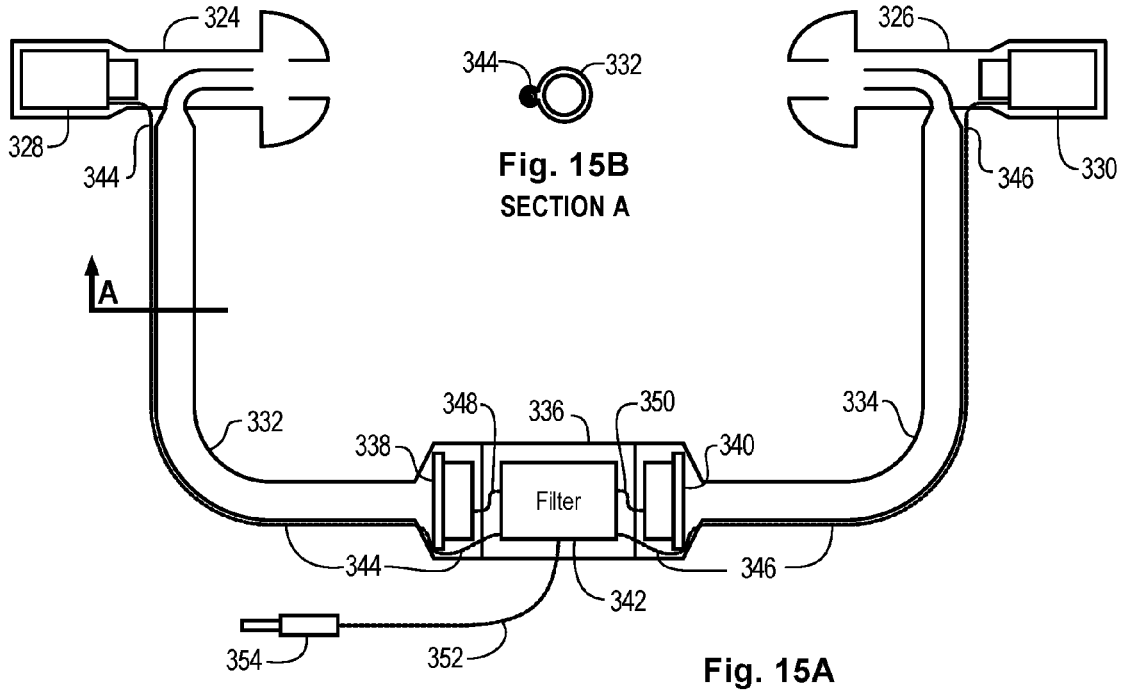
FIG. 15A is a section view drawing of an earphone according to an illustrative embodiment of the present invention.

Reference is directed to FIG. 15A, which is a section view drawing of an earphone assembly according to an illustrative embodiment of the present invention. A pair of manifolds 324, 326 each comprises direct-coupled first drivers 328, 330, and respective tubes 332, 334 coupled to respective second drivers 338, 340 located in a common housing 336. This drawing FIG. 15A particularly illustrates one exemplar circuit schematic and wiring diagram. In this embodiment, the signal source is received through a suitable jack 354 that is coupled to a filter circuit 342 located in the housing 336 through a suitable cable 352. For example, the filter may comprise a stereo low pass filter to segregate lower frequencies and a stereo high-pass filter to segregate higher frequencies. These filters will comprise an overlap range of frequencies that are supplied to both the low frequencies range and the high frequencies range. This overlap enhances the spatial quality of the reproduced sound, as was discussed hereinbefore. The filter 342 outputs signals to drive the several drivers.

The filter 342 in FIG. 15A couples stereo low frequency range signals to the pair of second drivers 338, 340 though internal wires 348, 350, respectively. The wiring 348, 350 is disposed entirely within the housing 336. Thus, these drivers 338, 340 constitute the left and right woofers, using the conventional stereo loudspeaker terminology. The filter 342 also outputs stereo high frequency range signals to the pair of first drivers 328, 330 through wires 344, 346, respectively. Thus, these drivers 328, 330 constitute the left and right stereo tweeters, using the conventional stereo loudspeaker terminology. Of course, it is necessary to run the wires 344, 346 from the filter 342 to the pair of first drivers 328, 330. In this embodiment, these wires 344, 346 are molded together with the tubes 332, 334, respectively, and are therefore, not exposed on the exterior of the assembly. FIG. 15B is a cross section A taken along tube 332. The wire 344 is co-molded, as illustrated.

Figure 16A:
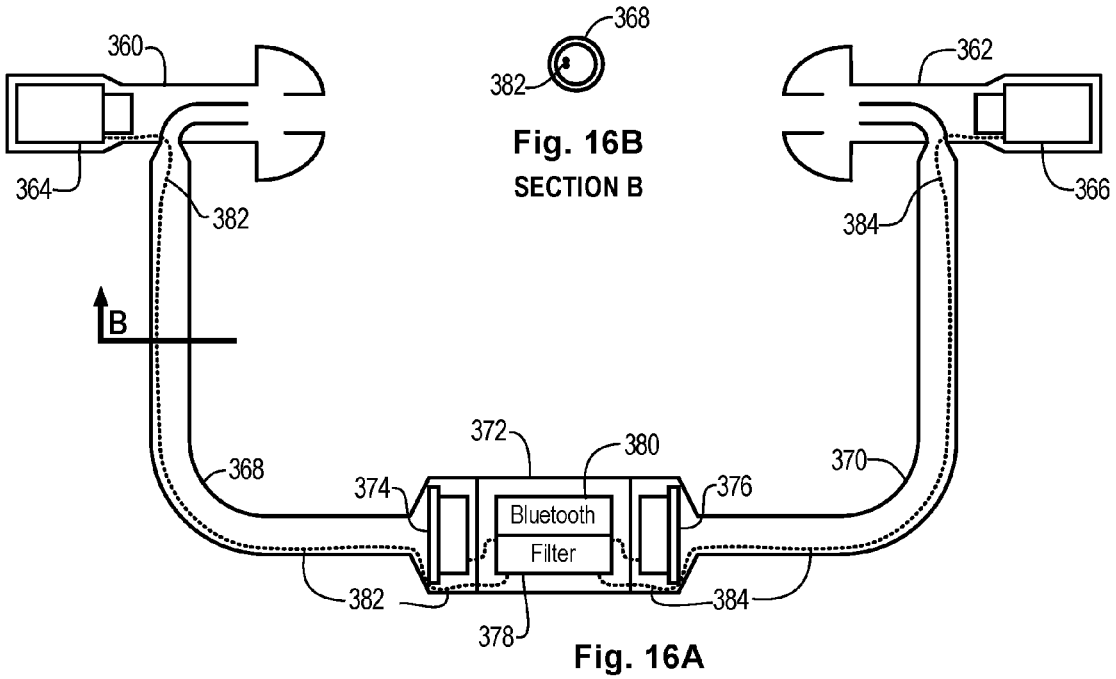
FIG. 16A is a section view drawing of an earphone according to an illustrative embodiment of the present invention.

Reference is directed to FIG. 16A, which is a section view drawing of an earphone according to an illustrative embodiment of the present invention. A pair of manifolds 360, 362 each comprises direct-coupled first drivers 364, 366, and respective tubes 368, 370 coupled to respective second drivers 374, 376 located in a common housing 372. This drawing FIG. 16A particularly illustrates one exemplar circuit schematic and wiring diagram. In this embodiment, the signal source is received through a Bluetooth wireless receiver 380, as are known to those skilled in the art. The received audio signals are coupled to a filter 378 within the housing 372. For example, the filter 378 may comprise a stereo low pass filter to segregate lower frequencies and a stereo high-pass filter to segregate higher frequencies. These filters will comprise an overlap range of frequencies that are supplied to both the low frequencies range and the high frequencies range. This overlap enhances the spatial quality of the reproduced sound, as was discussed hereinbefore. The filter 378 outputs signals to drive the several drivers.

The filter 378 in FIG. 16A couples stereo low frequency range signals to the pair of second drivers 374, 376 though internal wires, as illustrated. The filter 378 also outputs stereo high frequency range signals to the pair of first drivers 364, 366 through wires 382, 384, respectively. Of course, it is necessary to run the wires 364, 366 from the filter 378 to the pair of first drivers 364, 366. In this embodiment, these wires 364, 366 routed through the interior of tubes 368, 370, respectively, and are therefore, not exposed on the exterior of the assembly. FIG. 16B is a cross section 'B' taken along tube 368. The wire 382 is routed in the interior of the tube 368.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An earphone assembly, comprising:

a manifold;

a first driver, which emits first acoustic signals, directly coupled to a first port of said manifold;

a second driver, which emits second acoustic signals, coupled to a second port of said manifold through a tube having a length greater than 50 millimeters;

an earpiece coupled to an ear port of said manifold, and wherein said first driver and said second driver are driven from a common signal source, which results in a propagation time differential in the arrival of said first emitted signals and said second emitted signals at said third port.

2. The earphone assembly of claim 1, and wherein:

said tube has a length in the range between 50 millimeters and 250 millimeters.

3. The earphone assembly of claim 1, and wherein:

said first port and said second port of said manifold are arranged orthogonal to one another.

4. The earphone assembly of claim 3, further comprising:

a conduit coupled to said first port that extends into said manifold past said second port with an opening oriented in the direction of said ear port.

5. The earphone assembly of claim 3, further comprising:

a conduit coupled to said second port that extends into said manifold with an opening oriented in the direction of said ear port.

6. The earphone assembly of claim 3, and wherein:

said first port and said second port are arranged to emit said first signals and said second signals into said manifold in directions parallel to one another.

7. The earphone assembly of claim 1, further comprising:

a first conduit coupled to said first port that extends into said manifold with a first outlet oriented in the direction of said ear port, and a second conduit coupled to said second port that extends into said manifold with a second outlet oriented in the direction of said ear port.

8. The earphone assembly of claim 1, and wherein said common signal source is a first channel of a stereo signal source, which further provides a second channel, and wherein said manifold, first driver, tube, second driver, and earpiece constitute a first earphone, the assembly further comprising:

a second earphone comprised of substantially identical elements as said first earphone, which is driven by the second channel to thereby implement a stereo earphone assembly.

9. The earphone assembly of claim 1, further comprising:

a filter circuit, coupled to receive the common signal source, which selectively couples a first range of signal frequencies to said first driver and a second range of signal frequencies to said second driver.

10. The earphone assembly of claim 9, and wherein:

said first range of signal frequencies and said second range of signal frequencies each comprise an overlap portion of signal frequencies such that both of said first driver and said second driver receive said overlap portion of signal frequencies.

11. The earphone assembly of claim 1, and wherein:

said first driver and said second driver are selected from a dynamic driver, a balanced armature driver, and an electrostatic driver.

12. The earphone assembly of claim 1, and wherein:

said earpiece is selected from an ear-fitting earpiece, in-ear-canal earpiece, a circumaural earpiece, and a supra-aural earpiece.

13. The earphone assembly of claim 12, and wherein:

said earpiece is removably connected to said ear port of said manifold.

14. The earphone assembly of claim 1, and wherein:

said second driver further comprises a housing having plural sub-drivers disposed therein to couple plural corresponding audio frequency bands of said second acoustic signals to said tube.

15. A stereo earphone assembly, to be driven by a left signal and a right signal, comprising:

a left manifold having a left earpiece acoustically coupled thereto, and having a first left driver driven by the left signal, which directly emits first left acoustic signals thereinto;

a second left driver driven by the left signal, which emits second left acoustic signals, coupled to said left manifold through a left tube having a length greater than 50 millimeters, which results in a propagation time differential in the arrival of said first left and second left emitted acoustic signals at said left manifold;

a right manifold having a right earpiece acoustically coupled thereto, and having a first right driver driven by the right signal, which directly emits first right acoustic signals thereinto;

a second right driver driven by the right signal, which emits second right acoustic signals, coupled to said right manifold through a right tube having a length greater than 50 millimeters, which results in a propagation time differential in the arrival of said first right and second right emitted signals at said right manifold.

16. The stereo earphone assembly of claim 15, further comprising:

a driver housing disposed between the distal ends of said left tube and said right tube, which houses both of said second left driver and said second right driver, and thereby forms a loop of said left tube and right tube between said right manifold and said left manifold.

17. A stereo earphone assembly, to be driven by a left signal and a right signal, comprising:

a left manifold having a left earpiece acoustically coupled thereto, and having a first left driver driven by the left signal, which directly emits first left acoustic signals thereinto;

a right manifold having a right earpiece acoustically coupled thereto, and having a first right driver driven by the right signal, which directly emits first right acoustic signals thereinto;

a tube, having a length of at least 100 millimeters, acoustically coupled to both of said left manifold and said right manifold, and having a driver port located along its length;

a common driver, driven by both of the right signal and the left signal, which emits both of second right acoustic signals and second left acoustic signals, and coupled to said driver port to thereby couple both of said second right acoustic signals and second left acoustic signals to both of said left manifold and said right manifold, and which results in a propagation time differential according to the length of said tube from said driver port to said left manifold and said right manifold, respectively.

* * * * *